US006454321B1

(12) United States Patent
Parikh

(10) Patent No.: US 6,454,321 B1
(45) Date of Patent: Sep. 24, 2002

(54) ROTARY LATCH OPERATED BY A T-HANDLE WITH MULTIPLE LATCH ACTUATOR CONNECTION POINTS

(75) Inventor: Bhupendra Parikh, Parma, OH (US)

(73) Assignee: Cleveland Hardware and Forging Company, Cleveland, OH (US)

( * ) Notice: Subject to any disclaimer, the term of this patent is extended or adjusted under 35 U.S.C. 154(b) by 0 days.

(21) Appl. No.: 09/566,369

(22) Filed: May 8, 2000

Related U.S. Application Data

(60) Provisional application No. 60/173,015, filed on Dec. 23, 1999.

(51) Int. Cl.[7] ..... E05C 3/16

(52) U.S. Cl. ..... 292/216; 292/DIG. 31; 292/DIG. 53; 70/208; 70/210

(58) Field of Search ..... 292/216, 223, 292/226, DIG. 31, DIG. 53; 70/208, 209, 210

(56) References Cited

U.S. PATENT DOCUMENTS

| | | | | |
|---|---|---|---|---|
| 1,459,812 A | | 6/1923 | Zeman | |
| 3,884,056 A | | 5/1975 | East et al. | |
| 4,138,869 A | | 2/1979 | Pelcin | |
| 4,320,642 A | * | 3/1982 | Pastva | 292/DIG. 31 |
| D271,562 S | | 11/1983 | Weinerman | |
| 4,703,961 A | | 11/1987 | Weinerman et al. | |
| 4,911,487 A | | 3/1990 | Rachocki | |
| 4,951,486 A | | 8/1990 | Braun et al. | |
| 5,015,019 A | | 5/1991 | Razdolsky | |
| 5,042,853 A | | 8/1991 | Gleason et al. | |
| 5,046,340 A | * | 9/1991 | Weinerman | 292/DIG. 31 |
| 5,127,686 A | | 7/1992 | Gleason et al. | |
| 5,141,266 A | | 8/1992 | Braun et al. | |
| 5,409,272 A | | 4/1995 | McCormack | |
| 5,439,260 A | | 8/1995 | Weinerman et al. | |
| 5,526,660 A | | 6/1996 | Bennett et al. | |
| 5,551,793 A | | 9/1996 | Lewis | |
| 5,611,224 A | | 3/1997 | Weinerman et al. | |
| 5,820,174 A | | 10/1998 | Parikh et al. | |
| 5,941,104 A | * | 8/1999 | Sadler | 292/DIG. 31 |
| 5,984,383 A | * | 11/1999 | Parikh | 292/DIG. 31 |

FOREIGN PATENT DOCUMENTS

| | | | |
|---|---|---|---|
| DE | 2721979 | * 11/1978 | 292/216 |
| GB | 2 165 300 A | 4/1986 | |

OTHER PUBLICATIONS

Eberhard Catalog #108.

* cited by examiner

*Primary Examiner*—Flemming Saether
(74) *Attorney, Agent, or Firm*—Calfee, Halter & Griswold LLP

(57) ABSTRACT

A rotary latch system where a rotary latch has a trip pawl and a latch jaw which engages a striker. When a T-handle is turned, rotation is translated via a rotating member to an actuating lever. Movement of the lever triggers the pawl which releases the latch jaw. Linkages to other latches can be easily made by connecting to pins upon the rotating member. The latch can then act as a master latch which operates a group of latches. T-handle is spring biased to return to its starting position on release. A locking embodiment provides a lock assembly which interferes with the rotation of the actuating lever when system is in a locked position.

19 Claims, 6 Drawing Sheets

ROTARY LATCH OPERATED BY A T-HANDLE WITH MULTIPLE LATCH ACTUATOR CONNECTION POINTS

This application claims the benefit of U.S. provisional patent application No. 60/173,015 filed on Dec. 23, 1999, the entirety of which is hereby incorporated by reference.

FIELD OF THE INVENTION

The present invention pertains generally to latches and, more particularly to rotary latches which are operated by rotation of a handle.

BACKGROUND OF THE INVENTION

Rotary latches are used on any sort of door which needs to be held in a closed position. The benefit of most rotary latches is that the door to which they are mounted will spring open upon latch release and may be slammed back to a closed, latched position. A latch is released upon its actuation, which is commonly done via a handle. The handle and latch comprise a system and are typically mounted together upon a pan which is in turn attached to the door being latched. The most common handle used to actuate a rotary latch when both are mounted to a common pan is a paddle handle, as shown in U.S. Pat. No. 4,911,487.

The T-handle is used in some latch systems because of its strength, durability, and compact design. The T-handle has been used in latch systems which do not include a rotary latch, such as U.S. Pat. No. 5,526,660. Because a great deal of force can be translated through the T-handle, it is often used in a system where rotary latches or other devices being actuated are not mounted to the pan upon which the handle is mounted, but are located at a distance from this pan. The force of turning the handle is translated via rod or cable to the latch or device. Often multiple rods or cables are attached to a single T-handle, allowing coinciding actuation of multiple devices.(see FIG. 31 in U.S. Pat. No. 4,706,478) One problem with prior art latch systems is that they do not utilize a T-handle to actuate a rotary latch mounted upon a common pan. A further problem with prior art systems is that a T-handle is not used to actuate a rotary latch mounted to a common pan as well as devices not attached to the pan.

It is desirable to have a new rotary latch system which utilizes the durability and compact design of a T-handle in conjunction with a rotary latch where both latch and handle are mounted to the same pan. Further, it is desirable to utilize the strength of the T-handle by including a way to actuate latches or devices not mounted to the pan as well as the local latch.

SUMMARY OF THE INVENTION

The present invention overcomes these and other disadvantages in the prior art. The invention provides in one aspect a latch which functions as a releasable closure mechanism comprising a pan having a well with exterior and interior sides, a latch assembly attached to the pan generally along side the well, the latch assembly having a latch jaw and a trip pawl, an actuating lever rotationally mounted proximate to the pan and disposed in a plane generally parallel to the pan, the actuating lever configured to actuate the latch assembly to a release state, a shaft having first and second ends extending generally perpendicularly through the well and the mounting plate, a handle attached to the first end of the shaft on the exterior side of the well, and a rotating member attached to the second end of the shaft on an interior side of the well, with the actuating lever located between the rotating member and the interior side of the well, the rotating member positioned to contact the actuating lever upon rotation of the rotating member, so that the actuating lever trips the latch assembly.

The invention provides in another aspect a latch which functions as a releasable closure mechanism, the latch comprising a mounting plate having interior and exterior sides, a latch assembly attached to the said mounting plate, the latch assembly having a latch jaw and trip pawl, a shaft having first and second ends extending generally perpendicularly through the mounting plate, a handle attached to said first end of the shaft on the exterior side of the plate, a rotating member attached to said second side of the shaft, an actuating lever attached to said mounting plate and being in physical contact with said rotating member and said trip pawl, and said actuating lever configured to actuate the latch assembly upon rotation of said rotating member.

These and other aspects of the invention are herein described in particularized detail with reference to the accompanying Figures.

DETAILED DESCRIPTION OF THE INVENTION

Figures 1, 2:
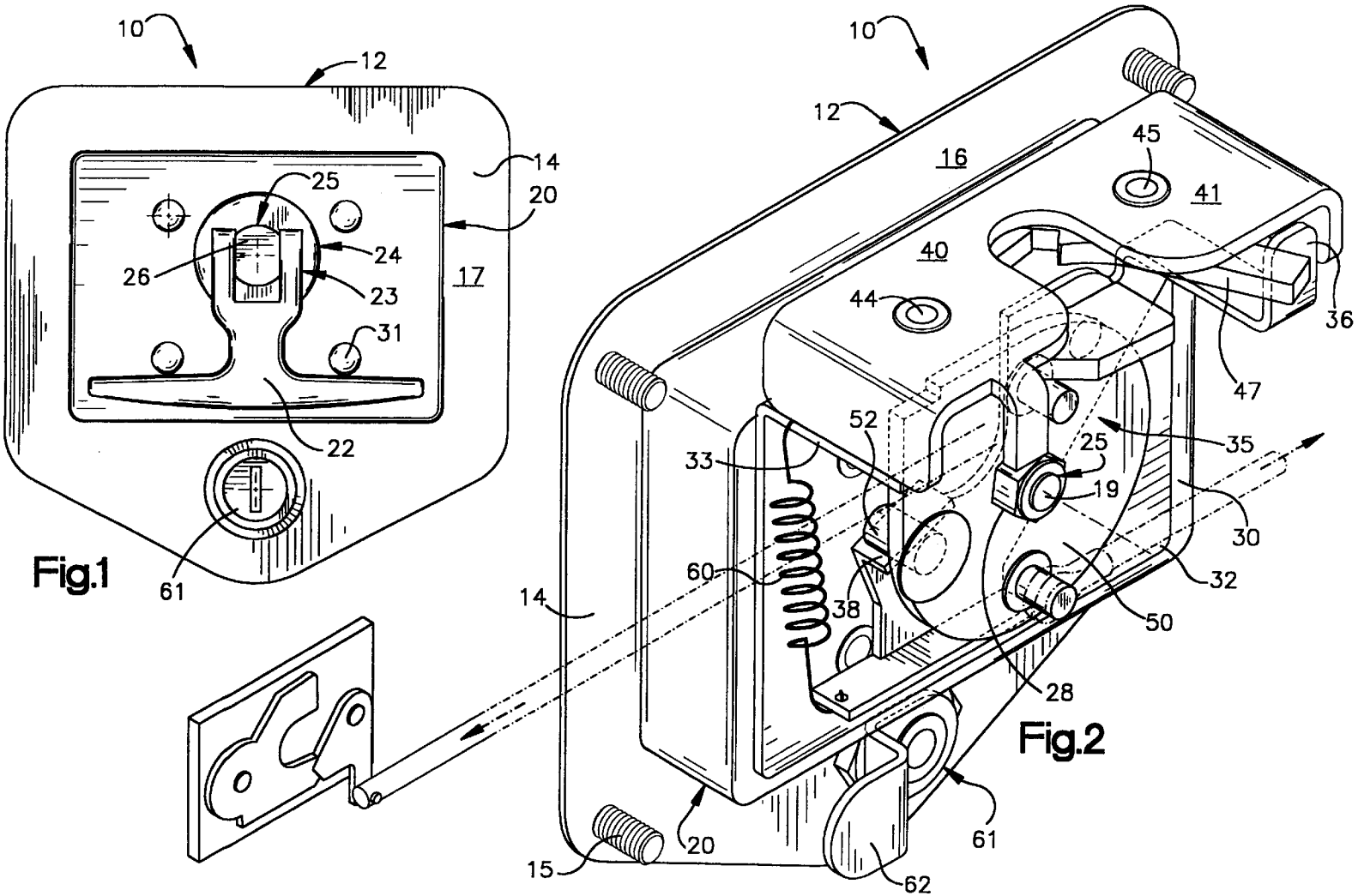
FIG. 1 shows a front view of a latch with the T-handle in a retracted position.
FIG. 2 shows a perspective view of the back side of a latch with connecting linkages extending from the latch.
Figure 7:
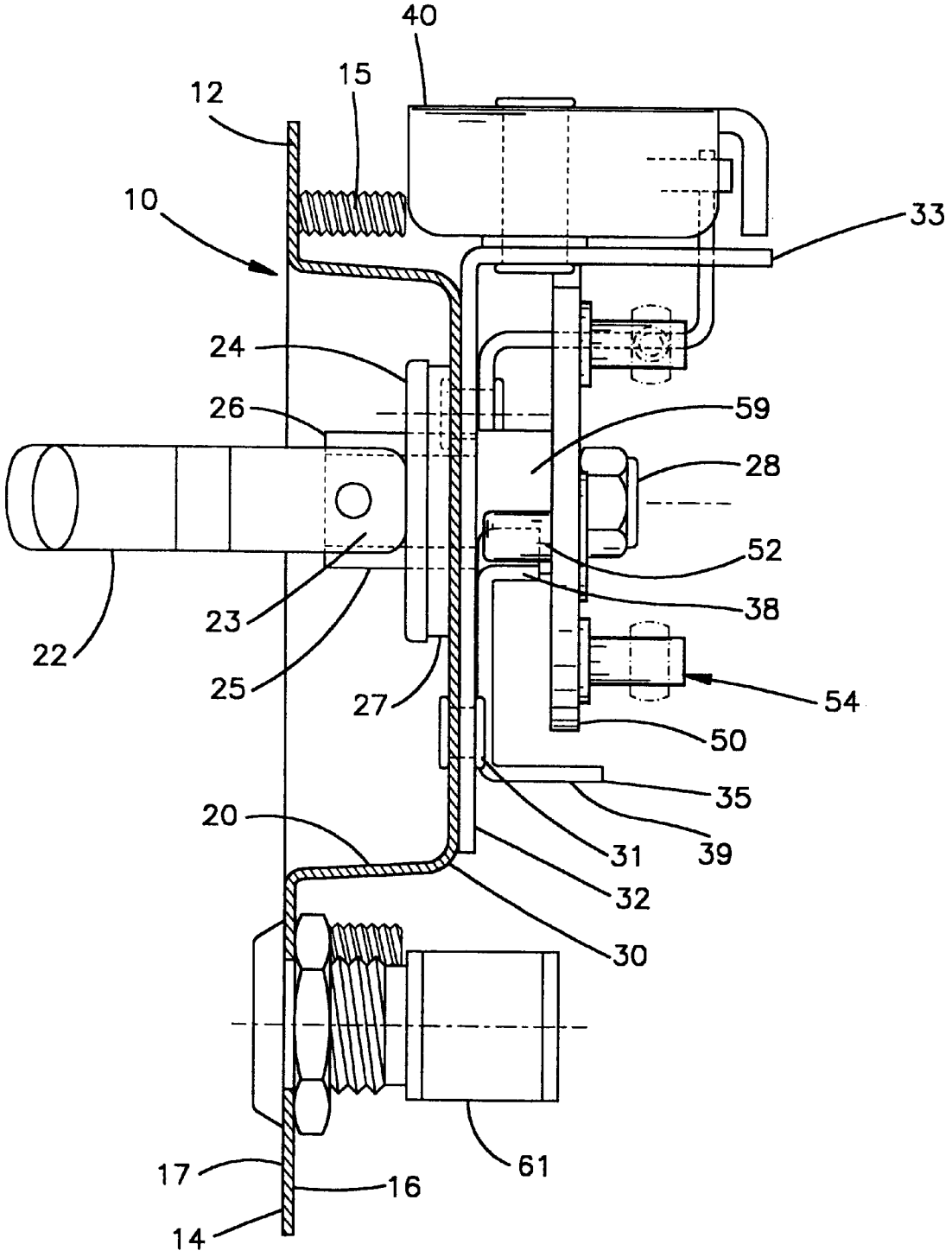
FIG. 7 shows a side view of the latch in a position where the handle has not been turned and the latch has not been released.

As shown in the Figures, a latch, indicated generally at 10, has a mounting pan 12 with a peripheral flange 14, which is typically mounted flush on an exterior surface of a panel or door which the latch operates. To accomplish such mounting, fasteners, preferably threaded studs or rivets 15 may be provided to extend from an interior side 16 of flange 14. An exterior side 17 of the pan, as shown in FIG. 1, is thus exposed in a typical installation. The pan 12 further has a well 20, recessed from exterior side 17, and in which an operating handle 22, such as a T-handle, fits in a retracted position. The T-handle 22 has forked extension 23 which is pivotally mounted upon a distal end 26 of a shaft 25 which extends through the well 20 of the pan. A cap washer 24 is provided about the distal end 26 of the shaft 25 between the exterior side of the well and the T-handle. An annular elastic seal 27 is provided between the cap washer 24 and the exterior side of the well, as shown in FIG. 7. The seal prevents moisture and foreign objects from passing through the pan, and dampens vibration of the T-handle against the pan and washer. The distal ends of the T-handle forked extension 23 are rounded to facilitate transition of the handle between the retracted position shown in FIG. 1, and the extended operational position shown in FIG. 7.

As further shown in the Figures, an optional latch mounting plate 32 is mounted on an interior side 30 of the well 20 of the pan, by fasteners 31 such as rivets or bolts. The mounting plate 32 substantially increases the strength of the overall latch system, as in this embodiment it covers substantially the entire expanse of a major flat portion of the well. The mounting plate 32 is not required and alternatively all parts mounted to plate 32 may be mounted directly to pan 12. An actuating lever 35 is rotationally mounted about one of the attachment points of the plate 32 to the pan, or alternatively rotationally mounted upon a pin extending from the mounting plate 32. The actuating lever 35 thus rotates in a plane parallel to the mounting plate and, as shown in FIG. 7, it can be closely parallel to the mounting plate.

Figure 4:
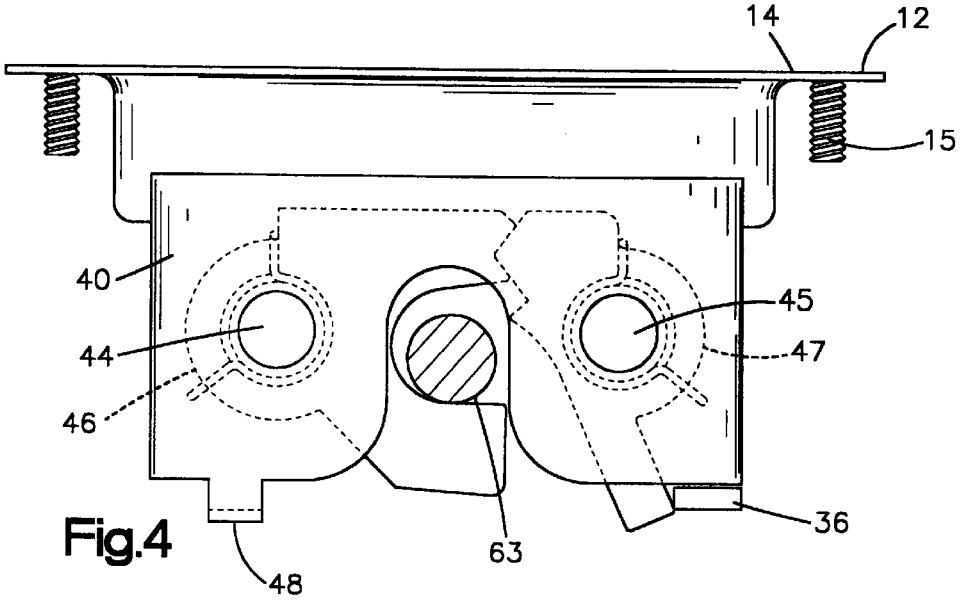
FIG. 4 shows a top view of the rotary latch assembly specifically showing the latch jaw and trip pawl in an unreleased position.

The mounting plate 32 additionally comprises a flange 33 which extends perpendicularly from the major flat portion of the mounting plate and away from the pan. Preferably, flange 33 is integrally formed with mounting plate 32, but may also be a separate piece attached by welding or other methods of fastening. Mounted upon the flange 33 is a rotary latch assembly indicated generally at 40. The rotary latch assembly 40 has a cover plate 41 attached to flange 33 by laterally spaced parallel pins 44 and 45. The flange 33 and latch cover plate 41 together form a housing in which a latch jaw 46 and a cooperating trip pawl 47 are rotationally and spring-biased mounted upon pins 44 and 45, respectively. The latch jaw 46 is spring biased to an unlatched position. The trip pawl 47 is spring biased to a position of engagement with the latch jaw 46. The latch jaw 46 preferably has a U-shaped opening which is designed to accept entry of a striker 63. The striker 63 is commonly mounted to a door jam if the latch is mounted upon a door. The cover plate 41 is also preferably equipped with a U-shaped notch 43 to receive the striker 63. Between the U-shaped surfaces of the latch jaw 46 and the cover plate 41, the striker 63 can be held in place when the latch 10, as shown in FIG. 4, is in a latched position. Cover plate 41 also has a tab stop 48 which stops the rotation of latch jaw 46 when the rotary latch is released.

Figure 3:
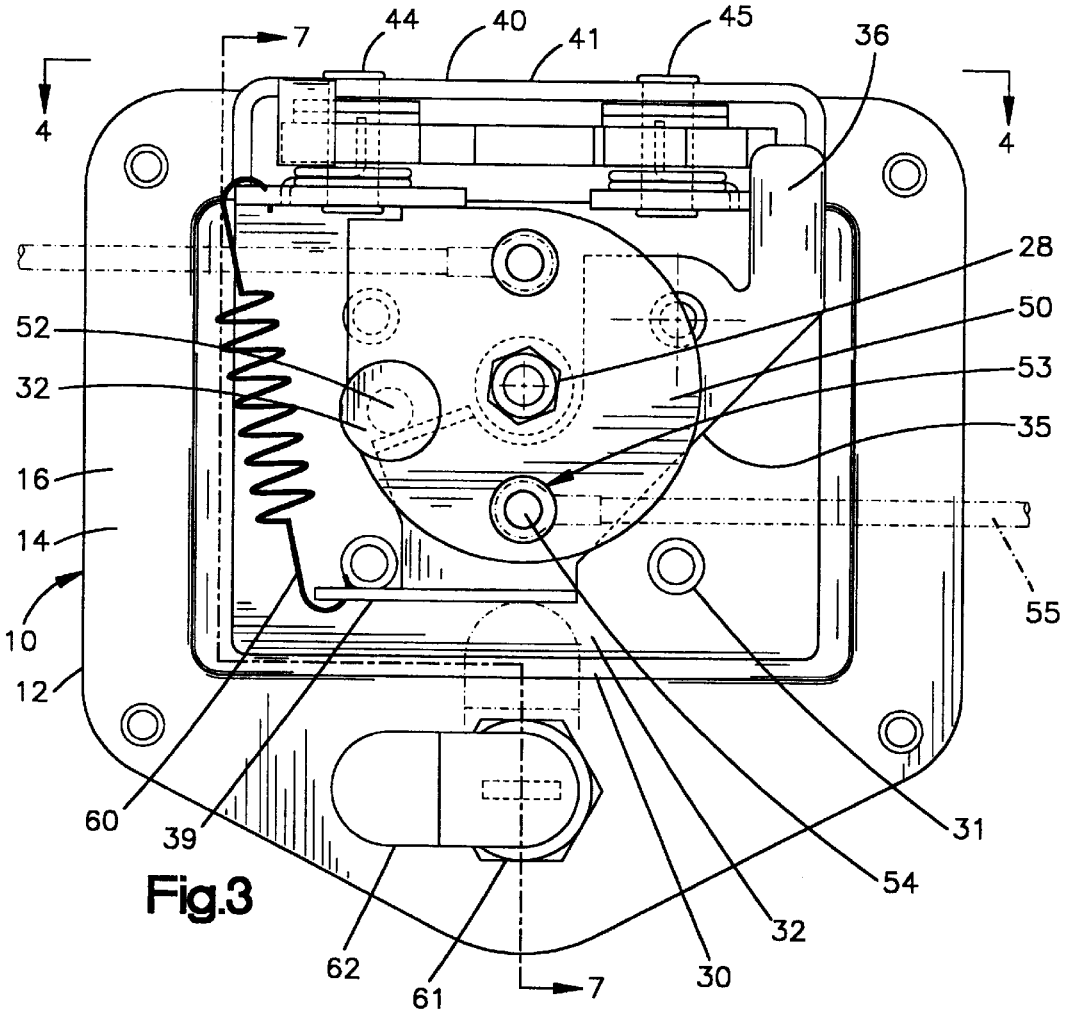
FIG. 3 shows a back side view of the latch in a position where the handle has not been turned and the latch has not been released.
Figure 8:
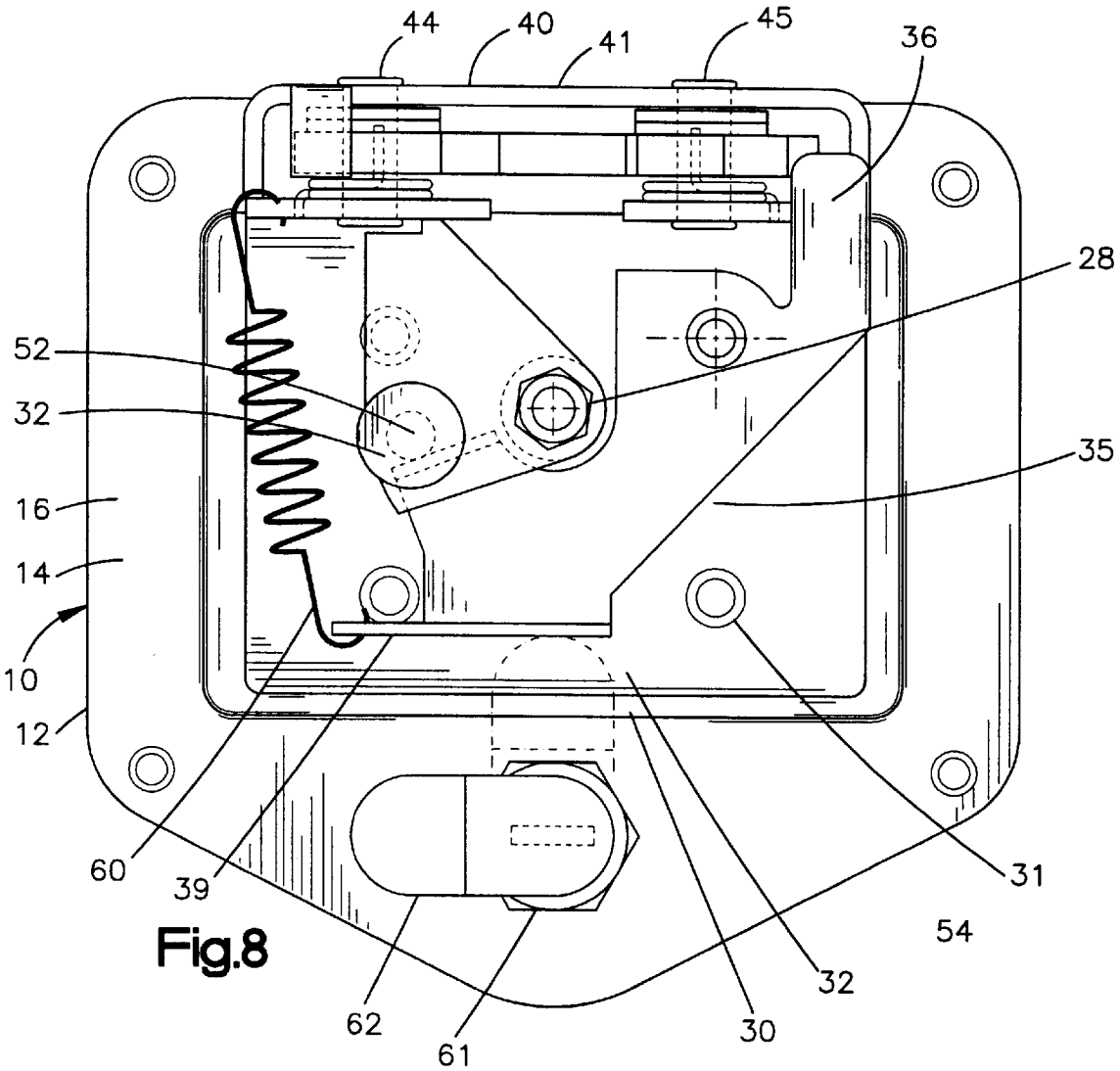
FIG. 8 shows a back side view of the latch having a rotating member of reduced size.

Referring to FIG. 7, shaft 25 passes through the well 20 of pan 12 and mounting plate 32. Rotating member 50 is mounted on the proximate end of shaft 25 and is held in place by a nut 28. On shaft 25, in between mounting plate 32 and rotating member 50 is a bushing 53. This gives the appropriate clearance between rotating member 50 and actuating lever 35. Referring to FIG. 3, one edge 51 of rotating member 50 is flat and is in contact with mounting plate 32 when the handle 22 is in an unrotated position. Thus rotating member 50 acts as a stop for the return rotation of handle 22. The rotating member has a contact pin 52 which extends generally perpendicularly from the generally planer rotating member 50 proximate to a tab 38 of the actuating lever 35. In a preferred embodiment rotating member 50 is a predominately circular disk. However, rotating member 50 need not be disk shaped, and may be any shape and size which is adapted to provide a flat surface 51 for stopping, the contact pin 52 and optional apertures 53 as shown in FIG. 8. Contact pin 52 is in constant contact with tab 38. In some embodiments, tab 38 may not be necessary and the contact pin 52 could simply contact an edge of a generally planer portion of the actuating lever 35.

Figure 5:
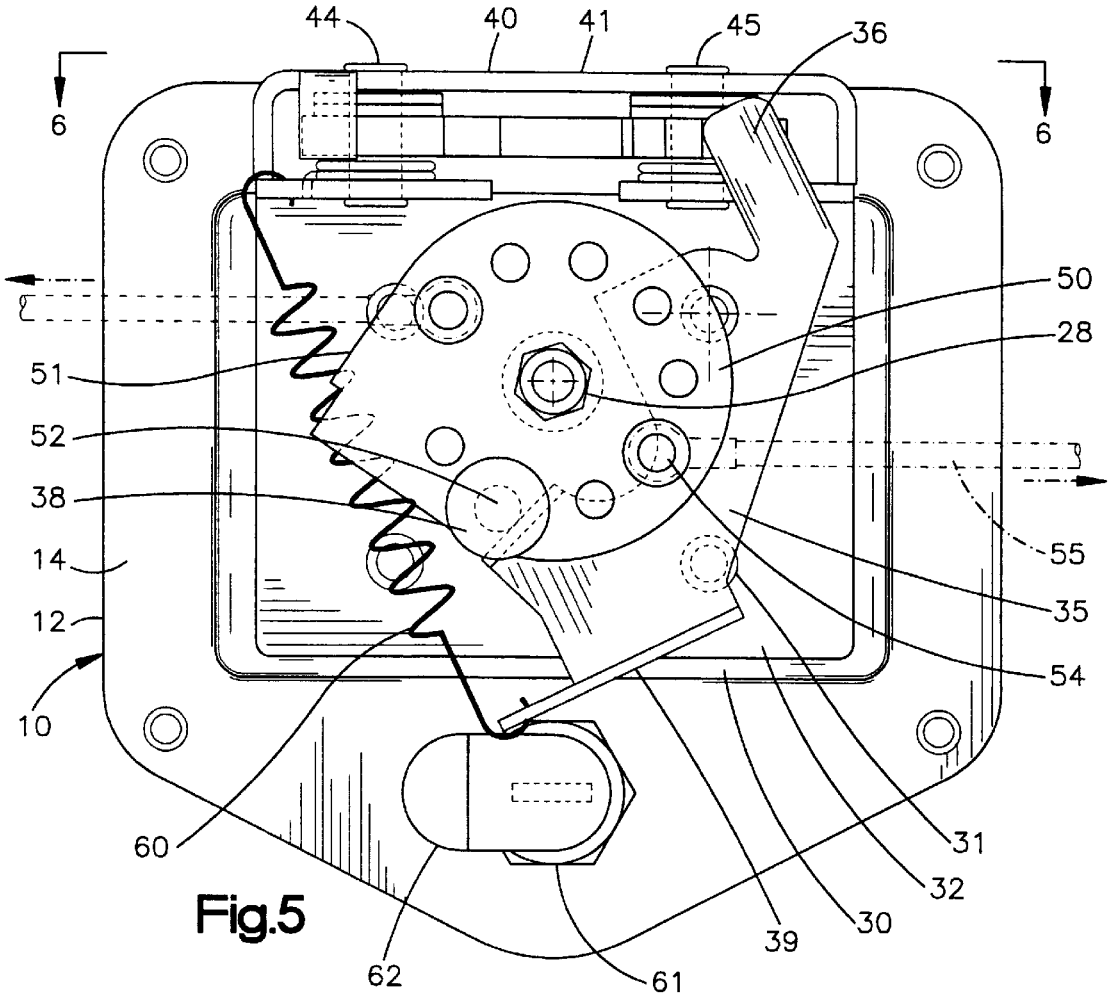
FIG. 5 shows a back side view of the latch in a position where the handle has been turned and the latch jaw and trip pawl released.
Figure 6:
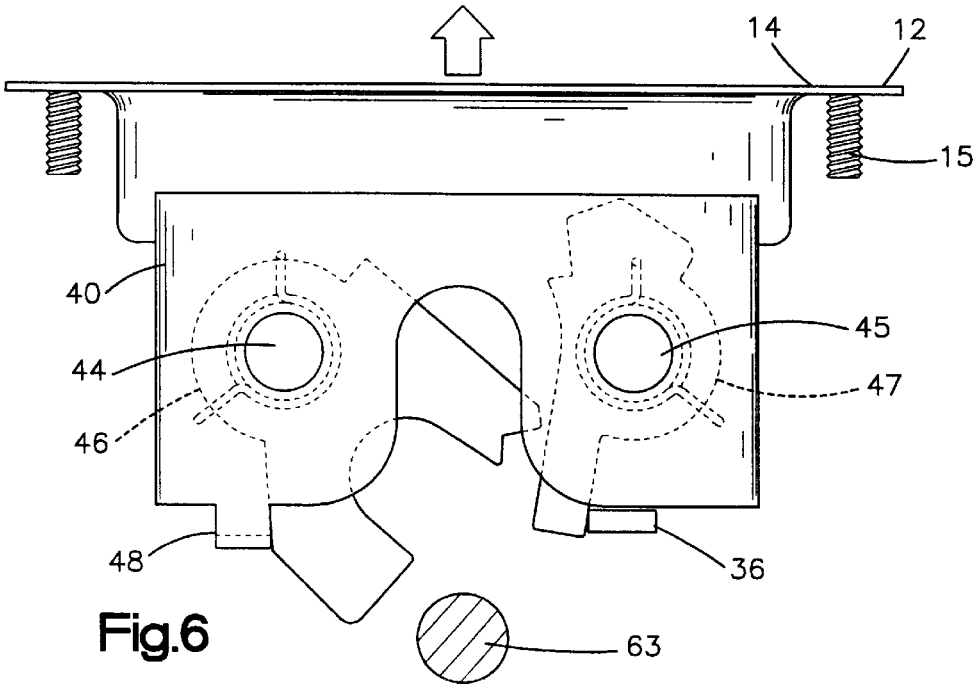
FIG. 6 shows a top view of the rotary latch assembly specifically showing the latch jaw and trip pawl in a released position and the entire latch moving away from the striker.
Figure 9:
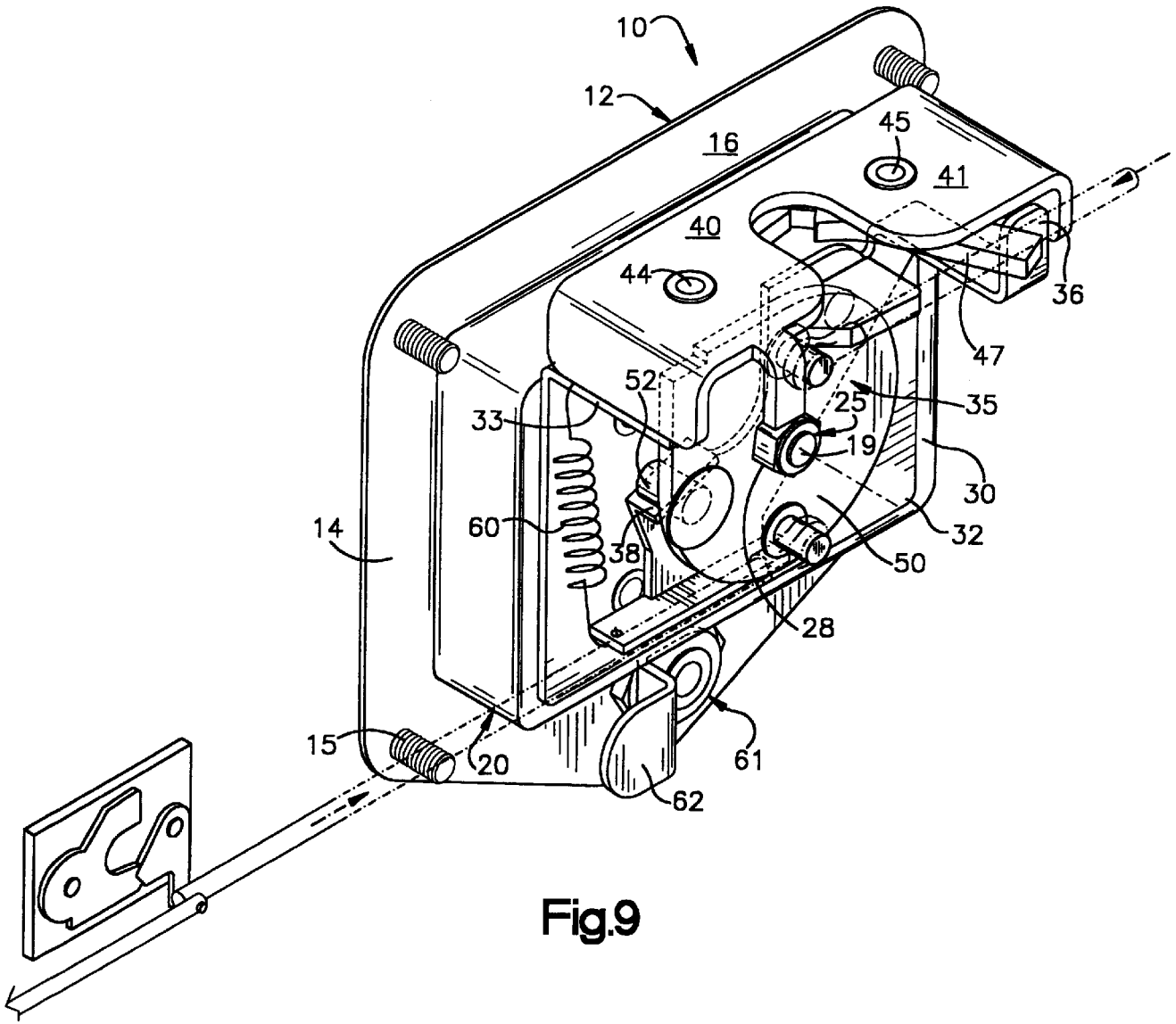
FIG. 9 shows a perspective view of the back side of a latch with connecting linkages extending from the latch.

Preferably, rotating member 50 has one or more apertures 53, as shown in FIG. 5, aligned radially on its face. A linkage connector pin 54 may be affixed within any of the apertures 53. The latch 10 may employ no connector pins or up to an amount equal to the number of apertures 53 available. The linkage connector pin 54 extends perpendicularly from the face of rotating member 50. The length of linkage connector pin 54 varies depending upon the amount of clearance needed between a linkage 55 and other parts of the latch. Linkage 55, which is mounted to linkage connector pin 54, extends from the latch 10 to a distant rotary latch or other device as shown in FIG. 2 and in FIG. 9. Linkage 55 may be a rigid rod or flexible cable. The latch 10 may employ no linkages 55 or up to an amount equal to the number of apertures 53 available.

Actuating lever 35 is a generally flat plate which has the following non planer actuation surfaces: trip finger 36, tab 38, and lock contact surface 39. Trip finger 36 is preferably an L shaped extension whose superior leg is perpendicular to the flat plane of actuating lever 35, and whose inferior leg is parallel to the plane of the actuating lever 35. Trip finger 36 is located at one end of actuating lever 35 and is positioned for contact with trip pawl 47. At the opposite end of actuating lever 35 is lock contact surface 39. Lock contact surface 39 is a tab extending outwards perpendicularly from the flat plane of actuating lever 35. One end of lock contact surface 39 extends beyond the width of actuating lever 35 and serves as a means to mount one end of a helical tension spring 60. The opposite end of spring 60 is attached to an area generally along the junction of mounting plate 33 and cover plate 41. Spring 60 acts to place rotating member 50 in contact with mounting plate 32.

An optional common barrel lock 61 may be used to lock the actuating lever 35 and handle 22 in an unrotated position. The face of lock 61 is mounted on the face of latch 10 as shown in FIG. 1. The barrel lock passes through mounting pan 12 into the latch interior. Lock 61 has a tang 62 that contacts nothing in an unlocked position, but contacts lock contact surface 39 of actuating lever 35 when in a locked position in order to prevent rotation of lever 35.

The operation of the latch assembly can now be described. In order to release the striker 63 from the latch 10, the latch jaw 46 which holds the striker 63 must be released. First, the tang 62 of barrel lock 61 is rotated to a position not in contact with lock contact surface 39. Next, handle 22 is unfolded from pan 12 and rotated. When handle 22 is rotated, shaft 25 and rotating member 50 also rotate. Contact pin 52, mounted upon rotating member 50 engages and moves actuating lever 35. When actuating lever 35 moves, trip finger 36 engages trip pawl 47. The movement of trip pawl 47 releases latch jaw 46 and thus releases striker 63 from the latch 10.

Next the handle 22 is released. When handle 22 is released, spring 60 pulls upon and moves actuating lever 35. Actuating lever 35 contacts and moves contact pin 52 which is mounted upon rotating member 50. Rotating member 50 rotates until contact is made with flange 33. In order to lock the latch system 10, the barrel lock 61 is rotated so that tang 62 is in contact with lock contact surface 39 of actuating lever 35. Thus, no rotation of the actuating lever 35, rotating member 50, shaft 25 or handle 22 is possible.

In an alternate embodiment, rotation of rotating member 50 moves a linkage 55. Movement of linkage 55 may trigger latches or other devices which are not mounted upon pan 12.

Although the invention has been shown and described with respect to certain preferred and alternate embodiments, the invention further includes other obvious variations which adopt or include the basic principles of the invention.

What is claimed as the invention is:

1. A latch which functions as a releasable closure mechanism, the latch comprising:

a pan having a well with exterior and interior sides;

a mounting plate mounted on the interior side of the well of the pan;

a latch assembly attached to the mounting plate generally along side the well, the latch assembly having a latch jaw and a trip pawl;

an actuating lever rotationally mounted proximate to the pan and disposed in a plane generally parallel to the pan, the actuating lever configured to actuate the latch assembly to a release state;

a shaft having first and second ends extending generally perpendicularly through the well and the mounting plate;

a handle attached to the first end of the shaft on the exterior side of the well;

a rotating member attached to the second end of the shaft on an interior side of the well, with the actuating lever located between the rotating member and the interior side of the well, the rotating member positioned to contact the actuating lever upon rotation of the rotating member, so that the actuating lever trips the latch assembly.

2. The latch of claim 1 further comprising a mounting plate attached to the well where:

the latch assembly is attached to the mounting plate;

the actuating lever is mounted proximate to the mounting plate and disposed in a plane generally parallel to the mounting plate.

3. The latch of claim 2 wherein the mounting plate covers a substantial expanse of the interior side of the major flat portion of the well.

4. The latch of claim 2 wherein the mounting plate further comprises a latch mounting flange which extends away from the interior side of the well.

5. The latch of claim 4 wherein the latch assembly is attached to the latch mounting flange of the mounting plate.

6. The latch of claim 4 Wherein the latch assembly comprises a cover plate attached to the latch mounting flange of the mounting plate by first and second pins and wherein the latch jaw is pivotally mounted upon the first pin, and the trip pawl is pivotally mounted upon the second pin, the trip pawl being in operative contact with the latch jaw to hold the latch jaw in a closed position, and to release the latch jaw to an open position.

7. The latch of claim 4 wherein the rotating member is generally planar and has a generally tear drop shape having a perimeter with a generally radiused segment and a generally straight edge section adapted to contact the latch mounting flange of the mounting plate.

8. The latch of claim 1 wherein the pan includes a mounting portion which is a generally peripheral flange which substantially surrounds the well.

9. The latch of claim 8 further including fasteners which extend from the peripheral flange of the pan.

10. The latch of claim 1 wherein the actuating lever is rotationally mounted upon a fastener which extends from the pan, the actuating lever further comprising a latch finger which extends to the latch assembly, and a surface for contacting the rotating member.

11. The latch of claim 1 wherein the actuating lever further comprises a rotating member contact flange.

12. The latch of claim 1 further comprising a bushing on the shaft between the pan and the rotating member.

13. The latch of claim 1 wherein the handle is a T-handle which fits within the well of the pan when in a retracted position.

14. The latch of claim 1 wherein the rotating member has at least one linkage connection point adapted for connection with linkages to other latches.

15. The latch of claim 14 wherein at least one linkage connection point is a pin which extends from the rotating member.

16. The latch of claim 1 in combination with at least one other latch connected by a linkage to the rotating member.

17. The latch of claim 1 further including a spring which biases rotating member into contact with latch assembly.

18. The latch of claim 1 further including a lock mechanism operative to prevent rotation of the actuating lever and handle.

19. The latch of claim 1 further including an annular elastic seal between said handle and said exterior side of well to prevent moisture from entering latch.

* * * * *